United States Patent [19]

Roberts et al.

[11] Patent Number: 4,746,401

[45] Date of Patent: May 24, 1988

[54] PROCESS FOR EXTRACTING LIGNIN FROM LIGNOCELLULOSIC MATERIAL USING AN AQUEOUS ORGANIC SOLVENT AND AN ACID NEUTRALIZING AGENT

[75] Inventors: Ronnie S. Roberts; John D. Muzzy, both of Atlanta, Ga.; George S. Faass, Bensalem, Pa.

[73] Assignee: Georgia Tech Research Corp., Atlanta, Ga.

[21] Appl. No.: 816,456

[22] Filed: Jan. 6, 1986

Related U.S. Application Data

[63] Continuation-in-part of Ser. No. 537,032, Sep. 29, 1983, abandoned.

[51] Int. Cl.[4] ..... D21C 3/20

[52] U.S. Cl. ..... 162/72; 162/77; 162/90

[58] Field of Search ..... 162/72, 77, 90, 19

[56] References Cited

U.S. PATENT DOCUMENTS 2,037,001 7/1981 Aronovsky ..... 162/77
4,496,426 1/1985 Baumeister et al. ..... 162/77
4,520,105 5/1985 Sinner et al. ..... 162/77
4,597,830 7/1986 April et al. ..... 162/77

OTHER PUBLICATIONS

Rydholm "Pulping Processes"; Int. Publishers, pp. 300–305, 1969.

*Primary Examiner*—Steve Alvo
*Attorney, Agent, or Firm*—Newton, Hopkins & Ormsby

[57] ABSTRACT

A process for the delignification of cellulosic materials, wherein a high-yield cellulose pulp and high-value by-product, such as reactive lignins of low molecular weight are produced, which comprises degassing lignocellulosic material, rapidly heating the lignocellulosic material in a liquor comprising water, an organic solvent and a buffer thereby maintaining a substantially neutral solvent extraction, such that said lignocellulosic material is cooked in the liquor as it is heated from a temperature of 150° C. to a selected maximum temperature in the range of 200° to 280° C.; and rapidly cooling the mixture to a temperature less than 150° C. The reaction is controlled to maximize reactive lignin solvation while suppressing cellulose degradation.

18 Claims, 4 Drawing Sheets

PROCESS FOR EXTRACTING LIGNIN FROM LIGNOCELLULOSIC MATERIAL USING AN AQUEOUS ORGANIC SOLVENT AND AN ACID NEUTRALIZING AGENT

CROSS REFERENCE TO RELATED APPLICATION

This application is a continuation-in-part of our copending application, Ser. No. 537,032, filed Sept. 29, 1983, and now abandoned, the subject matter of which is incorporated herein by reference.

BACKGROUND OF THE INVENTION

This invention relates to an organosolv progress for the delignification of lignocellulosic material to produce a high yield of fibrillateable cellulose pulp having a low residual content of lignin while also obtaining reactive lignin as a by-product. In contrast to prior art processes, the method of this invention is directed to a high temperature process controlled so as to cause solvation of reactive lignin to predominate while suppressing degradation of cellulosic material in order to enable recovery of high quality cellulose pulp and of reactive lignin.

Numerous commercial processes exist for producing cellulose pulp from wood. Generally stated, those processes which rely on inorganic chemicals as the extracting agent do not yield lignin as a valuable by-product. The liquor used may take many different forms but the extraction process normally proceeds in an acidic or in a basic environment. If a high quality lignin by-product is to be recovered, the process used is usually of the so-called organosolv type, in which the liquor is an aqueous solution of an organic solvent. Exemplary of such a process is U.S. Pat. No. 3,585,104 which teaches the use of a digesting liquor containing an aqueous mixture of lower aliphatic alcohols such as methanol, ethanol, propanol or aqueous mixtures of the lower aliphatic ketones such as acetone, as appropriate digesting or pulping agents. As is conventional in the prior art with respect to such liquors, U.S. Pat. No. 3,585,104 teaches a pulping temperature of between 150° C. to 200° C. and common residence times of an hour or more at the cooking temperature. No consideration is given with respect to the overall cooking time during which the liquor is subjected to a temperature which will promote cellulose/hemicellulose degradation, i.e., the time during which the liquor and consequently the wood material therein is subjected to temperatures exceeding about 150° C.

Also exemplary is U.S. Pat. No. 2,037,001 to Aronovsky wherein it is taught to employ an aqueous liquor containing a mono-hydroxy alcohol which has at least four carbon atoms of which at least three are in a straight chain. The invention disclosed in that patent is the use of an alcohol, as aforesaid, which is not miscible with water in all proportions at higher temperatures. Aronovsky teaches that when the aqueous liquor is at an elevated digesting temperature, the water and alcohol form a homogeneous solution in which the pulping takes place, but upon cooling to room temperature, the liquor forms two immiscible phases. One phase is the water phase containing inorganic chemicals in solution, and the other phase is the alcohol phase containing extracted lignin and other by-products. The pulp is in a solid phase and is separated from the liquid phase for recovery. It is taught that at the lower temperature at which the pulp is recovered, there is less opportunity for lignin to precipitate back onto the pulp because it remains solubilized in the alcohol layer which is stronger than when miscible with and hence diluted by water at the higher temperatures. It is taught that a purer lignin extract can be recovered from the alcohol layer and that more economical recovery of the alcohol is possible.

Aronovsky also teaches that extractive digestion of ligneous materials in an aqueous alcohol solution proceeds best in acidity. This patent recognizes that too much acidity exerts a hydrolytic action on the cellulose but that if alkalis such as caustic soda, sodium sulphide and sodium carbonate are added to avoid too low a pH, they exert an inhibiting action on the process of solvating lignin. In contrast, and in order to avoid this inhibitive action, urea in relatively small quantities is taught to be added as an agent to prevent high acidity in the digester. The result is that the digestion takes place at a higher pH than where urea is not used. The patent teaches the use of less than 5% of urea (yielding an acidic final pH) and that this amount of urea is fully as effective as 40% urea (which would yield a basic final pH).

Example 1 of the Aronovsky patent teaches a digestion temperature of 185° C. and a cooking time of 2 hours at that temperature with no urea addition to yield 39.2% pulp with 2% lignin content, which pulp is noted to be comparable to that obtained by "the known 'soda process'". In Example 2, the process of Example 1 was varied by displacing the cooking liquor and dissolved content with hot fresh liquor after one hour cooking time and continuing the cooking for an additional hour, yielding a higher percentage (51%) of pulp, residual lignin content being unspecified. Examples 3 and 4 of the patent employ the process but with different woods, teaching digestion temperature of 185° C. and cooking time of 5 hours at that temperature, without urea addition, and yielding 45.7% pulp with 10% residual lignin and 50.5% pulp with 11.9% residual lignin respectively. Examples 5 and 6 use different alcohols, teaching digestion temperature of 175° C. and a cookiing time of 4 hours at that temperature, without urea addition, to yield 53% and 54% pulp respectively, no residual lignin content being specified. Example 7 of the patent teaches the use of 4.5% urea based on dry wood at a digestion temperature of 175° C. and cooking time of 4 hours at that temperature in order to achieve a high yield of cellulose pulp. A yield of 67.2% pulp is specified but residual lignin content thereof is not mentioned. In discussing Example 7 in comparison with the same process without urea, it is noted that "urea functions by decomposition to provide ammonia which is available to neutralize acid formed in the digestion, thus preventing a low pH (high acidity) in the digester. The result is that the digestion takes place at a higher pH than where urea is not used. This minimizes loss of and degradation and alteration of celluloses and pentosans of the original wood." These examples are in accord with the conventional pH, temperatures and times at cooking temperatures, i.e. an acidic environment, temperatures less than 200° C. and long cooking times at the cooking temperature.

BRIEF SUMMARY OF THE INVENTION

It is considered that in the prior art, there is no teaching of the critical importance of controlling an organosolv process with respect to the manner in which the temperature, total time of the cooking process and the pH of the liquor are interrelated so as to obtain the objectives of this invention.

The cellulosic content of wood, particularly hemicellulose, is very susceptible to degradation under any conditions in which organosolv pulping is normally carried out. Commercial pulping processes are usually either acidic or basic. These acids or bases promote lignin fragmentation and solvation but, unfortunately, acids and bases also promote undesirable side reactions such as lignin condensation and depolymerization of hemicellulose/cellulose (herein "cellulose degradation"). Cellulose degradation not only reduces the yield and quality of recovered pulp but it also creates the condition in which condensation of lignin with the products of cellulose degradation occurs, thereby degrading the quality of recovered lignin as well. Therefore, as an ideal, it would be desirable to conduct the pulping under the conditions in which cellulosic degradation is minimized while solvation of reactive lignin is maximized but with a minimum of lignin condensation.

We have discovered that delignification of lignocellulosic materials in an organosolv liquor can be controlled as to pH, temperature range, heating and cooling rates and consequent cooking time so that the process predominantly becomes one of reactive lignin solvation with minimized carbohydrate degradation. As a result, the residual lignin content of the cellulose pulp decreases at a rapid rate while the yield of high quality cellulose pulp decreases at a slower rate, whereupon the process is rapidly terminated to yield the requisite combination of pulp yield and residual lignin content. The process is significantly improved if the liquor contains an additive such as methylanthraquinone (MAQ) which not only increases the rate of reactive lignin solvation but also blocks lignin condensation reactions. These additives may be aromatic additives containing electron donating groups and fused aromatic ring compounds capable of undergoing a single electrophylic substitution, of which anthraquinone and 2-naphthol are additional examples.

This invention concerns the delignification of lignocellulosic material such as wood by a process which is predominantly one of reactive lignin solvation to recover a high yield of carbohydrate fraction in the form of chemical grade, fibrillateable, high molecular weight cellulose/hemicellulose pulp with low residual lignin content and a lignin fraction in the form of reactive lignin. By "high yield" is meant a yield of at least about 50 wt % pulp based upon dry wood (lignocellulosic material) and by "low residual lignin content" is meant not more than about 10 wt % residual lignin content based upon the amount of recovered pulp.

The invention is based on several interrelated discoveries concerning the relationships among process steps essential to achieve the objectives sought. The solvation process employs a digesting liquor which is an aqueous organic solvent containing an acid neutralizing agent and, preferably, an additive such as methylanthraquinone, 2-naphthol or anthraquinone. Lignocellulosic material is immersed to impregnate it with the liquor. The liquor with the immersed material is next controllably heated to a high digesting temperature followed by rapid cooling to promote lignin solvation and then the ultimate separation and recovery of the fractions of interest.

One discovery is that the liquor must be provided with an acid neutralizing agent which causes the liquor, during an early or first stage of the cooking process, to attain a substantially neutral pH which is thereafter retained during the cooking process. By "substantially neutral" is meant a pH of from about 6.0 to about 8.0 and preferably 6.8 to 7.5. By "early or first stage" is meant that stage of the cooking process during which the liquor is being heated through a temperature range of about 150° C. to about 175° C. By "cooking process" is meant that portion of the overall process which takes place while the temperature of the liquor is above a temperature of approximately 150° C., i.e., above that temperature at which significant cellulose/hemicellulose degradation begins to occur.

By "total cooking time" is meant the time period during which the cooking process is being carried out and represents the time necessary to yield both the pulp of high molecular weight with low residual lignin content and the reactive lignin. In accord with this invention, the total cooking time is separated into stages, namely, a first stage in which the liquor is heated through the temperature range of about 150° C. to about 175° C., a second stage in which the liquor is heated through a temperature range of about 175° C. to the maximum cooking temperature which is within the range of about 200° C. to about 280° C., a third stage (if present) in which the liquor is maintained at the maximum cooking temperature for a finite residence time, and a last or final stage in which the liquor is cooled to a temperature of less than about 150° C.

Further discoveries are that the maximum temperature attained during the second stage (above about 175° C.) of the cooking process must be high, i.e., in the order of about 200° C. to about 280° C., that the heating rate during the second stage should be as high as possible and in any case preferably higher than the heating rate during the first stage, and that the cooking process must be terminated by rapid cooling to a temperature of less than about 150° C. so that the total cooking time during which the liquor remains at a temperature of more than about 150° C. is controlled to yield chemical grade cellulose pulp of a desired low content of residual lignin with a minimum of cellulose/hemicellulose degradation and to yield by-product lignin which is reactive.

Preferably, the first stage of cooking should proceed at a heating rate of about 3.0° C. to about 6.0° C./minute over the temperature range of about 150° C. to about 175° C. in order to allow sufficient time for acids being formed in the lignocellulosic material (i.e., acetic and formic acids) to escape from the lignocellulosic material and become dissolved in and neutralized by the solvent system.

Thereafter, the second stage of the cooking process may proceed at the same heating rate as the first stage. However, it is preferable that it proceed at a higher heating rate of at least about 6° C./minute or more until the maximum cooking temperature is reached and the final stage should proceed at a cooling rate which is as rapid as possible.

A further discovery is that the cooking process is most effective when the heating rate during the second stage of cooking is high enough to permit the aforesaid third stage of the cooking process to exist before the cooking process must be terminated due to the incipient attainment of the desired percentage yield of high quality pulp with the desired low residual lignin content.

That is, the process is most effective with respect to the high pulp yield with low residual lignin content when the liquor may be held at the maximum cooking temperature for a finite period of time (the residence time) before the cooking process must be terminated by cooling. This is related to the discovery that, at any given temperature within the maximum cooking temperature range herein, the ratio of the rate of reactive lignin solvation to the rate of cellulose/hemicellulose degradation is most favorable and thus optimum during some finite residence time during the third stage of the cooking process. We have discovered that whereas the rate at which cellulose/hemicellulose degradation proceeds at any given temperature is substantially uniform with time, i.e. temporally independent, the rate of reactive lignin solvation at the same given temperature is temporally dependent. Specifically, we have found that the rate of reactive lignin solvation is initially very high at any such given temperature followed a short time thereafter by a sharply decreased rate of reactive lignin solvation. Thus, if the time taken during the second stage of cooking is shortened by maximizing the heating rate during that stage, less cellulose/hemicellulose degradation takes place during that time and a residence time or third stage of cooking is possible. In regard to this, it is to be understood that the higher the maximum cooking temperature, the less residence time is permissible before cooling is necessary. Thus, at the maximum cooking temperature of about 280° C., it is entirely possible that no residence time is available before cooling must be effected, depending upon the rate of heating during the second stage of the cooking process.

This invention is directed to high temperature and, if possible, residence time at the maximum cooking temperature, delignification of cellulosic material such as wood in a liquor which is an aqueous organic solvent, with or without the presence of additive which aids lignin extraction and stabilization of cellulose, but in the presence of an acid neutralizing agent which causes the reaction to proceed under substantially neutral conditions.

We have discovered that in a liquor containing neutralizing agent as aforesaid, whereas the rate of cellulose degradation is temperature dependent (increasing with temperature) it is substantially temporally independent, whereas the rate of reactive lignin solvation, although also increasing with temperature, proceeds at each temperature at an initially high rate for a short period of time, followed by a sharply defined and decreased rate of reactive lignin solvation. The transition at each temperature from the high rate of reactive lignin solvation to the decreased rate of reactive lignin solvation has been found to occur after only a few minutes for the temperature range of 200° C. to about 280° C., the time required to attain the transition varying inversely with temperature.

We have also discovered that whereas recovery of a high yield of cellulose pulp with low residual lignin content and the recovery of reactive lignin is attained in accord with this invention when the heating of the liquor is carried out with relatively rapid and even with a uniform rate of heating from about 150° C. to the maximum cooking temperature followed immediately by rapid cooling to a temperature of less than 150° C., both the yield of pulp and the low content of residual lignin therein is improved if it is possible to hold the liquor at the maximum cooking temperature for some period of time before the cooling is carried out. That is to say, if the liquor is heated to the maximum cooking temperature within the maximum cooking temperature range of 200° C. to 280° C. with sufficient rapidity from about 175° C. to the maximum cooking temperature, a residence time at the maximum cooking temperature, ranging inversely with maximum cooking temperature between instantaneous or zero time to about 30 minutes is possible and extremely beneficial.

Since the problems of cellulose degradation and pate of solvation are of primary concern, we may use conventional additives such as methylanthraquinone (MAQ) which are known to reduce lignin condensation reactions and to stabilize carbohydrate pulp. Thus, a high yield of relatively undegraded cellulose pulp with low residual lignin content and the recovery of high quality lignin can be idealized by selecting the combination of temperature and residence time which completes the delignification. In this regard, it is important to heat the liquor as rapidly as possible and, when the reaction is substantially complete, to cool the liquor as rapidly as possible, thus to minimize unwanted cellulose degradation and lignin condensation.

The above and further advantages of this invention will be more apparent as this description proceeds.

BRIEF DESCRIPTION OF THE DRAWING FIGURES

DETAILED DESCRIPTION OF THE PREFERRED EMBODIMENTS

Figure 1:
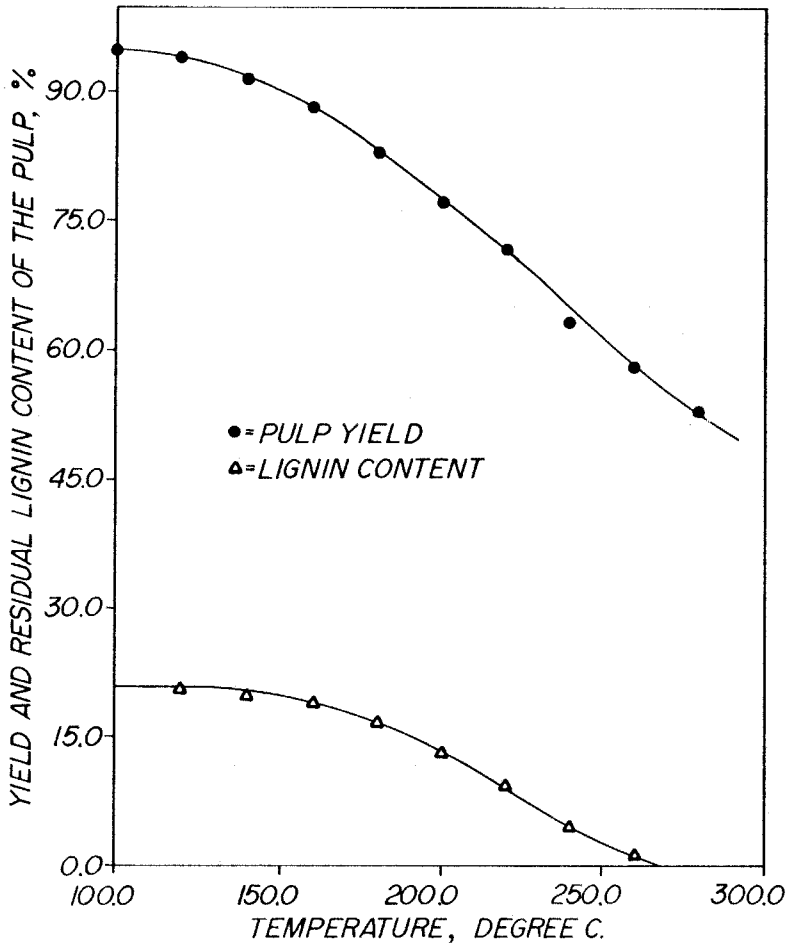
FIG. 1 is a graph of temperature vs yield and residual lignin content of the pulp for a typical process of this invention in which no third cooking stage or residence time is employed.

With reference to FIG. 1, the results shown therein were in relation to a series of cooks in which the mixture of wood material and liquor was heated rapidly to a maximum temperature in the range of from 100° C. to 280° C. and then immediately cooled very rapidly. As will be recognized, such cooking omits the third stage of cooking. The lignocellulosic material was tulip popular chips which were reduced to a nominal 1 mm particulate size by Wiley milling. Pulping cooks were performed using a 650 ml stirred batch reactor manufactured by Pharr Instruments, Inc. The material was first degassed followed by soaking in a pulping liquor composed of ethanol, water, sodium bicarbonate and methylanthraquinone in proportions as follows:

Ethanol—180 ml
Water—120 ml
Sodium bicarbonate—7.7 g
Wood (dry)—33 g
MAQ—1.2 g

The mixture of liquor and material submerged therein was charged into the reactor, rapidly heated to the desired temperature and immediately cooled rapidly.

The results of such cooks are shown in FIG. 1 wherein it will be seen that delignification essentially does not occur until the temperature exceeds about 160° C., but thereafter proceeds quite rapidly. The residual lignin content of the pulp does not follow the delignification curve except as to general trend. In these cooks, which are identified as nonisothermal cooks for convenience, the maximum time taken to heat to temperature was about 32 minutes and the maximum time taken for cooling was about 12 minutes.

Figure 2:
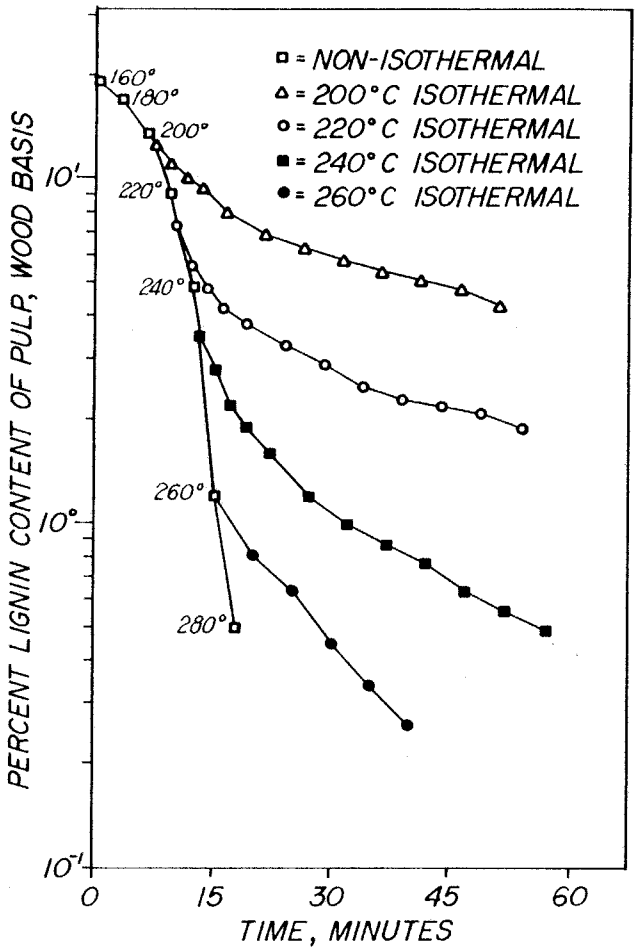
FIG. 2 is a graph of time vs the logarithm of percent lignin content comparing residual lignin content of this invention with and without residence time.

A further series of cooks was undertaken, these being named for convenience as isothermal cooks. In these isothermal cooks, the reactor was heated to a specific temperature of from 200° C. to 260° C., held at that temperature for up to 45 minutes and then rapidly cooled. As will be apparent, the so called isothermal cooks are of the type which include the third stage of cooking in accord with this invention. A comparison between the isothermal and the nonisothermal cooks is shown in FIG. 2. Consider, for example, the upper curve of this graph. The time period through the first 5 or so minutes represents the first stage of the cook, i.e., the time taken to heat from about 150° C. to about 175° C. The second cooking stage is the time taken to heat from about 175° C. to the maximum cooking temperature, 200° C. in this case, and the second stage time is about 5 minutes (10 minutes total for the first and second cooking stages combined). Thereafter, the temperature of 200° C. is held for a third cooking stage which lasts about 45 minutes. The final or cooling stage takes about five minutes. The total cooking time, in this case, is about one hour. In all of the isothermal cooks, it will be seen that the delignification proceeds more slowly during the third cooking stage in comparison to continued heating during the second cooking stage. However, since cellulose degradation proceeds more rapidly the higher the temperature reached at the maximum cooking temperature, it will be apparent that the third cooking stage offers the possibility for a slowing of cellulose degradation due to the temperature being held steady, even though the factor of time-at-temperature is introduced.

Figure 3:
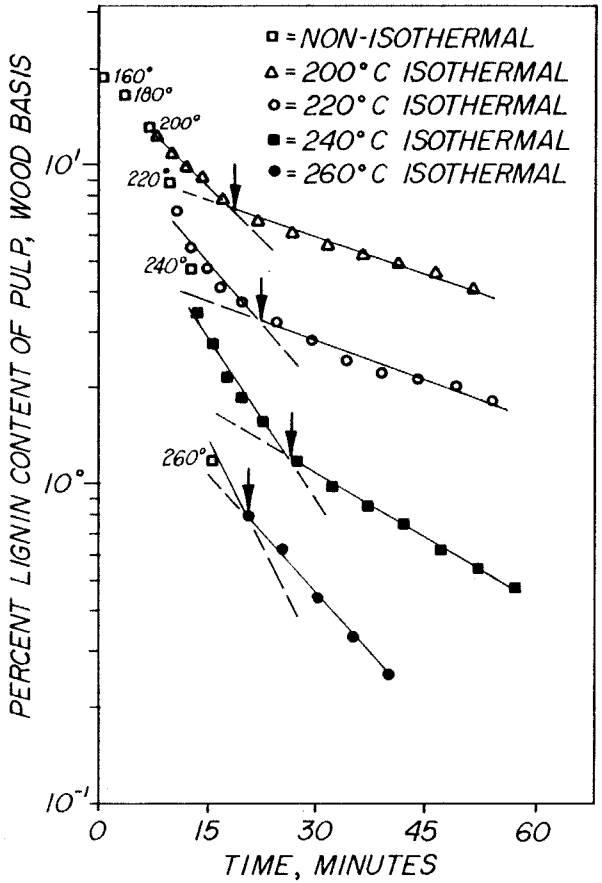
FIG. 3 is a plot of the data of FIG. 2 illustrating the transition from higher to lower rate of reactive lignin solvation at various temperatures.

FIG. 3 is a plot of the data points of FIG. 2 with straight lines drawn through the isothermal points to the extent possible. As reference to FIG. 3 will show, at any given temperature within the maximum cooking temperature range, the rate of delignification has been found to proceed initially at a very high rate as illustrated by the straight line to the left having a relatively steep slope, followed within a few minutes by a transition, marked by an arrow in FIG. 3, to a sharply decreased rate as illustrated by the line to the right having a lesser slope. Since the rate of cellulose degradation for the temperature in question has been found to be substantially time-independent, the ratio of reactive lignin solvation to cellulose degradation is highly favorable all during the rapid rate of delignification shown in FIG. 3 and transposes to a less favorable ratio at the transition point between the two lines for any given temperature. Since the end point of any cook is the total cooking time at which the desired combination of yield of high quality pulp and low content of residual lignin is reached, the faster the maximum cooking temperature can be reached, the longer the time period for the third stage cooking is possible.

Generally, it is preferable to raise the temperature of the pulping mixture as quickly as possible. The pulping mixture may be heated rapidly to 150° C., but the process is relatively indifferent to the manner in which the mixture is heated to this temperature. However, it is especially important to conduct the heating between the temperatures of about 150° C. to about 175° C. at a heating rate which allows about 4 to 10 minutes for this first cooking stage in order to allow acids being formed in the wood to emerge therefrom and be immediately neutralized by the liquor containing the acid neutralizing agent. Consequently, the heating rate during the first stage of cooking should be in the order of about 3° C./minute to about 6° C./minute. For the second cooking stage one should heat rapidly above 175° C. to the maximum cooking temperature. Although heating at a rate of only about 3° C./minute during the second cooking stage will work, much higher heating rates are desired in order to minimize the second stage time and allow more time for the third stage of cooking. Similarly, it is preferable to reduce the pulping temperature of the mixture to terminate the cooking process as quickly as possible in order to reduce the amount of time during which the wood chips are above about 150° C.

While the wood chips may be rapidly heated to a temperature of 200° C. or greater, it is preferred that the wood chips be rapidly heated above 175° C. at greater than 3° C./min to within the range of 200° C. to 280° C. Temperatures in excess of about 280° C. may result in degradaton of the liberated cellulose. However, it is especially preferred to heat the submerged wood chips from about 175° C. rapidly to the maximum cooking temperature in the maximum cooking temperature range of 200° C. to 280° C. at a heating rate of at least 6° C./min. and most preferably at a heating rate of at least about 10° C./minute.

Since the cooling rate effects the termination of the cooking process, it is important to effect the cooling at as rapid a rate as is possible, i.e., at a cooling rate of more than 10° C./minute and preferably at a rate of at least about 20° C./minute.

The digestion of the wood chips in the liquor composition during the third stage of cooking is performed for a residence time ranging from substantially instantaneous or zero time up to a residence time of 30 minutes. The higher the maximum cooking temperature, the lesser the residence time needed.

It has been found that by utilizing the conditions noted above, it is possible to effect the separation of the cellulose from the lignin with the least damage to the liberated cellulose. The use of high temperatures ensures rapid lignin extraction whereas the rapid heating during the second stage of cooking allows the use of third stage cooking which ensures minimal product degradation. These conditions allow high production rates per unit volume thus allowing low processing costs.

Figure 7:
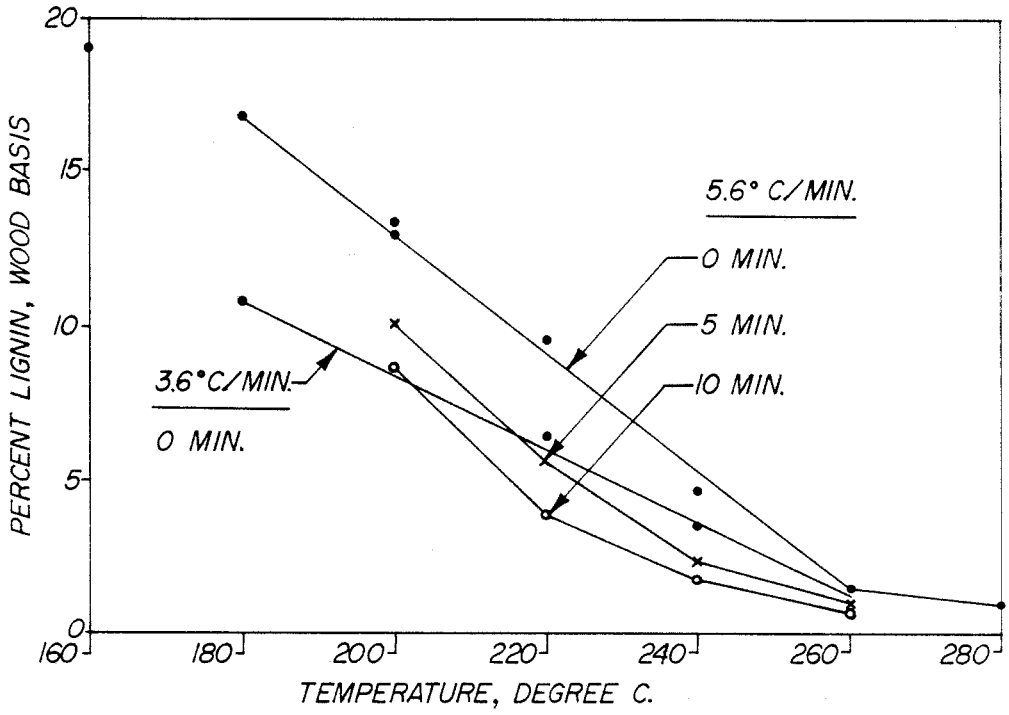
FIG. 7 is a graph of temperature vs % residual lignin comparing heating rates at zero residence time and various residence times for a given heating rate.

The effect of heating rate on the residual lignin content is illustrated in FIG. 7. The curve indicating a heating rate of 3.6° C./minute with zero residence time (no third stage cooking) shows an apparent improvement over the higher heating rate of 5.6° C./minute with zero residence time, but the two curves relating to this higher heating rate with the short residence times of 5 and 10 minutes clearly demonstrate that the introduction of the third stage of cooking quickly establishes superiority over the lower heating rate with no third stage cooking.

Figure 4:
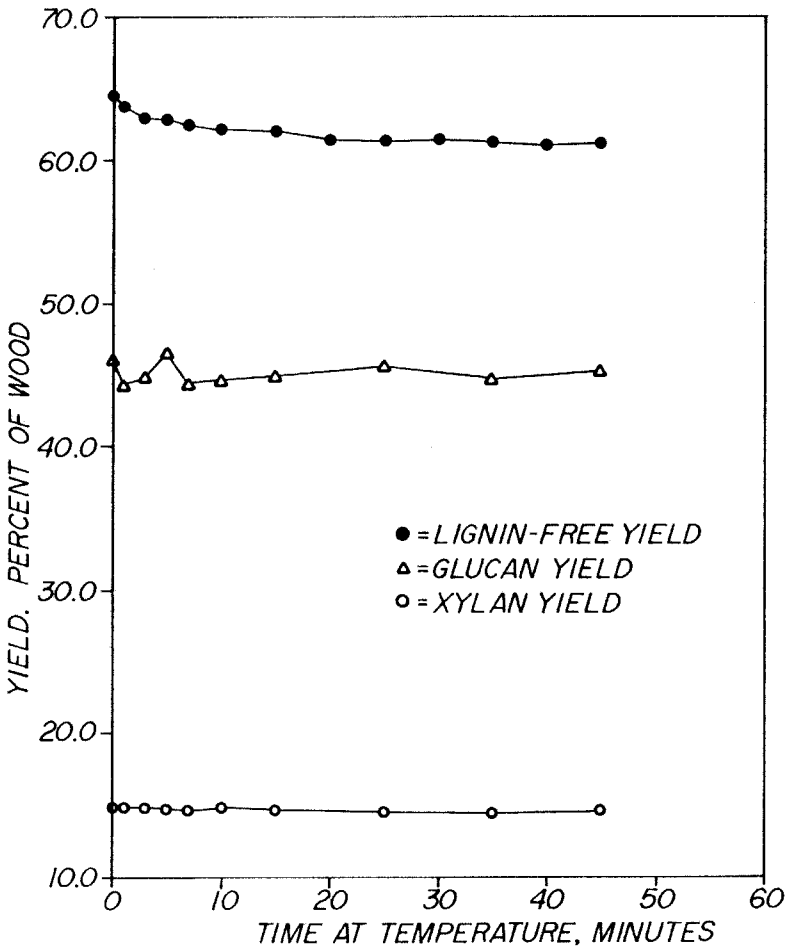
FIGS. 4–6 are graphs of residence time vs lignin-free pulp yield and carbohydrate content of the pulp at different maximum cooking temperatures.
Figure 5:
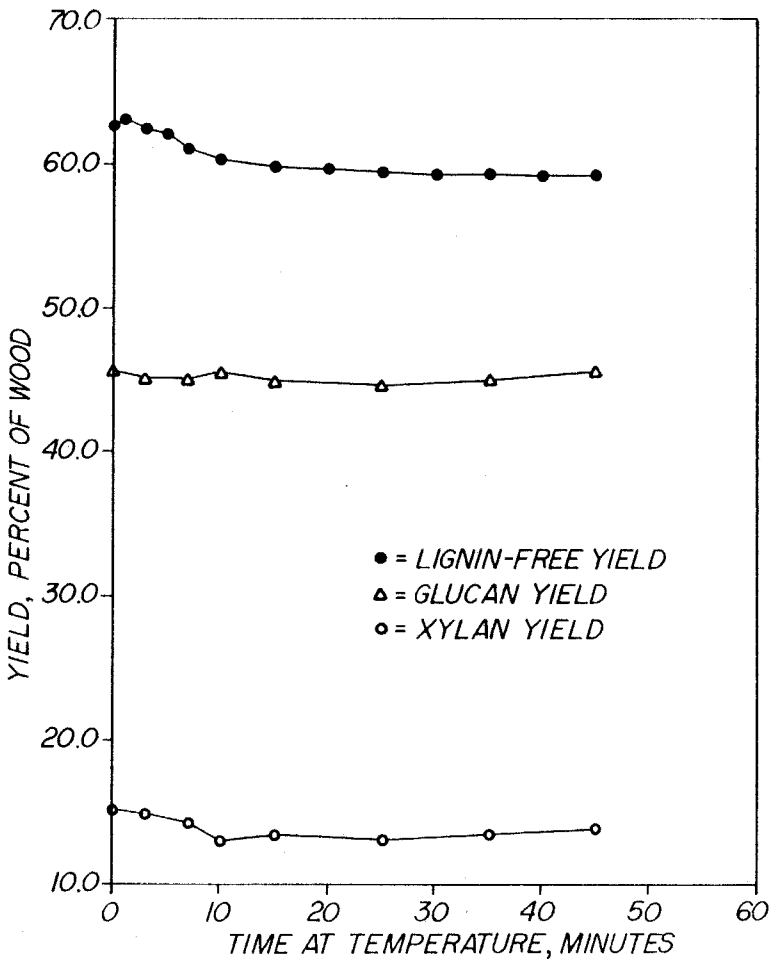
Figure 6:
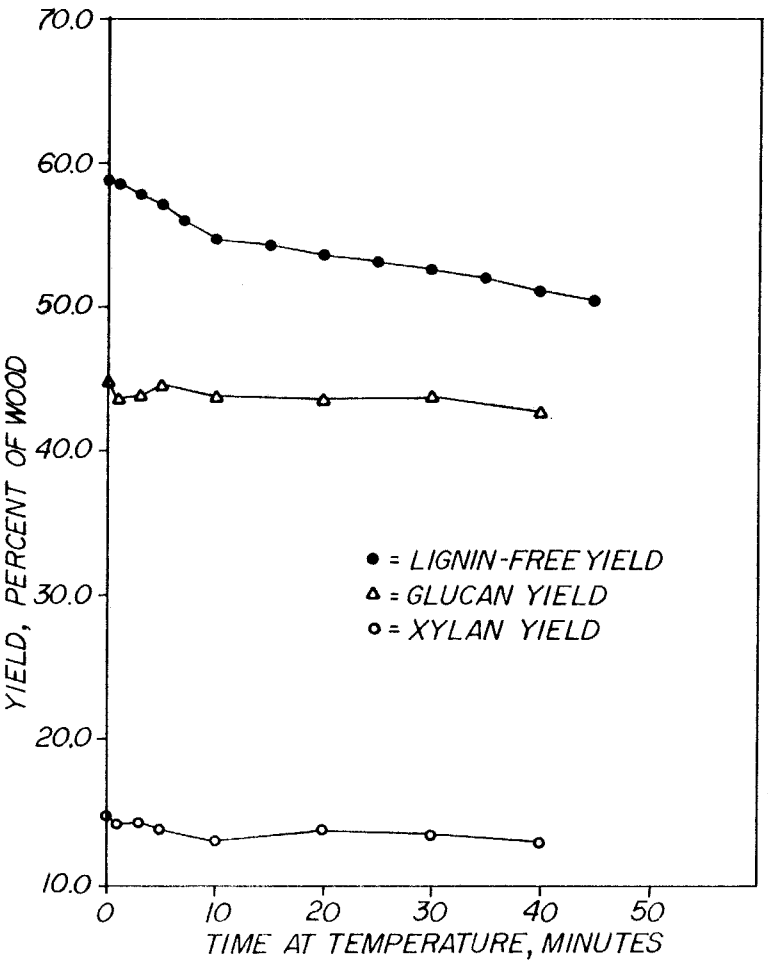

FIGS. 4–6 also demonstrate that the third stage residence time does not significantly affect cellulose degradation.

Systems which may be utilized to heat and cool the pulping liquor mixture of the present invention are known to those skilled in the pulping art. For example, rapid heating can be achieved by vapor injection and rapid cooling by vaporization at reduced pressure.

Wood chips or other lignocellulosic material are degassed to remove gases which cause oxidation of the wood chips and to promote uniform penetration of the pulping liquor. The wood chips are rapidly heated in a liquor containing water, an organic solvent and an acid neutralizing agent such that the wood chips are submerged in the liquor, from a temperature of about 150° C. to a maximum cooking temperature within the range of 200° C. to 280° C., held at such maximum cooking temperature for a period of time which ranges from zero or instantaneous up to 30 minutes, and then the mixture is rapidly cooled.

It is important to degas the wood chips prior to rapidly heating the submerged wood chips in the digesting liquor. By degassing the wood chips, the rate of oxidative degradation of the liberated cellulose is reduced, so as to ensure the attainment of a cellulose of high molecular weight in the cellulose pulp. Also degassing facilitates liquor penetration into the chips, providing more uniform delignification. In degassing the wood chips, an ordinary aspirator apparatus may be used to produce a vacuum. These devices are well known, and their operation is understood by those skilled in the laboratory sciences. Alternatively, hot soaking by means such as hot liquor reflux at atmospheric pressure or steaming may be employed to accomplish degassing and uniform pulping liquor penetration.

To terminate the digestion or cooking process, the mixture is rapidly cooled to a temperature below 150° C. at a cooling rate of at least 10° C./min. However, it is especially preferred to cool the mixture to a temperature in the range of 20° C. to 90° C. at a cooling rate of greater than 20° C./min.

Digestion of the wood chips in a liquor of water and an organic solvent maintained in a neutral state allows the lignin to solubilize, reduces the degradation of carbohydrate materials and reduces lignin condensation.

A wide variety of organic solvents may be used. However, preferred as the organic solvents are the straight-chain or branched-chain alcohols having up to about 8 carbons. For example, alcohols such as isopropyl alcohol or ethyl alcohol can be used. However, ethanol is the preferred alcohol. A solvent to wood ratio in the range of 3 to 30 ml of solvent to 1 gram of wood may be used. However, it is preferred to use a solvent to wood ratio in the range of 4 to 10 ml per 1 gram of wood.

In addition to using the preferred lower alcohols having up to 8 carbons, any of the other conventional organic solvents used in the delignification of cellulosic materials may be used in the present process. For example, aqueous solutions of lower aliphatic ketones may also be used in the present invention. Aqueous solutions of other organic solvents such as ethylene glycol, or dioxane may be used as well.

The digesting process of the present invention is principally carried out as a neutral process. More particularly, the neutral solvent extraction of lignin from cellulosic materials reduces the formation of undesired by-products such as furfural and condensed lignins.

A neutral solvent extraction is carried out by the addition of a acid neutralizing agent to adjust pH. Any acid neutralizing agent may be used which functions to maintain a substantially neutral solvent extraction. Sodium bicarbonate or sodium carbonate are preferred acid neutralizing agents. Other possible acid neutralizing agents are sodium phosphate, sodium citrate and calcium phosphate. The controlled addition of a base, such as sodium hydroxide may also be employed to obtain a neutral state. The selection of an appropriate acid neutralizing agent may easily be made by anyone skilled in the chemical arts. The amount of acid neutralizing agent used may be substantially reduced by recycling the salts, such as sodium acetate and sodium formate, from the pulping liquor, due to the requirements of chemical equilibria.

While the initial pH of the reaction mixture may be as high as about 10.0, it is important that the pH of the product mixture be maintained at a pH range of about 6.0 to 8.0 during operation above 175° C., as measured by a conventional pH meter at ambient temperature. It is preferred that this pH be in the range of about 6.8 to 7.5.

Additionally, an additive in the form of an organic stabilizer and/or inhibitor may be added to the liquor to help increase pulp yield while reducing the yield of undesired by-products. For example, the use of methylanthraquinone (MAQ) as an additive at elevated temperatures protects carbohydrate peeling and reduces lignin condensation. Another additive found to work well is 2-napthol. As a general rule, quinones containing electron donating groups and fused aromatic ring compounds capable of undergoing a single electrophylic substitution would serve as additives in the present invention.

Different additives appear to inhibit different side reactions and, therefore, it may be preferrable to use a combination of additives in an amount up to 15% of the lignocellulosic material on a dry weight basis.

The obtained lignin has a high market potential as it is more reactive than that obtained by present commercial pulping processes. For example, it can be readily converted to monoaromatic compounds in high yield. One approach for such conversion is catalytic hydrogenolysis as proposed by Hydrocarbon Research, Inc. Gendler, Huibers and Parkhurst, *Wood and Agricultural Residues: Research on Use for Feed, Fuels, and Chemicals*, E. Soltes, ed., Academic Press, pp 391–400 (1983).

Moreover, the reactive lignin of the present invention can be directly substituted for phenol in numerous polymer applications. The lignin obtained by the present process can be reacted with condensation polymers due to the reduced degree of lignin condensation occuring in the present extraction liquor which maintains a substantially neutral pH during delignification. Thus, both the cellulose pulp and lignin obtained from this invention have high market value, whereas in commercial pulping processes only the cellulose pulp is of value.

The cellulose pulp is produced in high yield by the present process. Moreover, the cellulose in the liberated pulp has a high molecular weight. Also, by using the process of the present invention, it is possible to obtain a cellulose pulp having less degradation of the hemicelluloses fraction. As the hemicelluloses are the most abundant of the polymeric cementing materials which hold the cellulose fibers together, their preservation results in the isolation of a superior fiber.

By maintaining the fibrous structure of the cellulose, the process of the present invention is useful for producing cellulose derivatives as well as nonwoven cellulosic structures. When the present process is performed under its preferred condition, it will typically yield an unbleached cellulose pulp leaving less than 10% lignin based upon weight % of the cellulose pulp and more than 20% hemicellulose by weight.

Batch digesters may be used as well as continuous digesters. A varying temperature profile may be used as well as a sequential addition to solvent, acid neutralizing agent, or base. Compared to conventional organosolv pulping, the present invention provides a higher yield of cellulose pulp and higher production rates per unit of reactor volume.

In the alternative, instead of placing the liquor and lignocellulosic material in a single digester, the liquor and material may be placed in a first digester heated to a temperature in the range of about 150° C. to about 175° C. and held in that digester for from about 4 minutes to about 10 minutes. Then the liquor and material may be transferred from the first digester to a second digester and held there for up to 30 minutes, the second digester being heated to a temperature in the range of about 200° C. to about 280° C.

Also, practically any hard or soft wood or other lignocellulosic material may be treated according to the present invention. Of course, by treating wood chips it is possible to expose a large surface area of the wood to the pulping liquor, thereby producing better results.

The present invention will be further illustrated by certain examples and references, tabulated below, which are provided for purposes of illustration only and are not intended to limit the present invention.

TABLE 1

| Example | 1 (control) | 2 (control) | 3 (control) | 4 |
|---|---|---|---|---|
| Neutralizing Agent, Sodium bicarbonate (wt % wood) | 0 | 0 | 20 | 27 |
| Alcohol (ethanol) (vol % liquor) | 0 | 55 | 0 | 55 |
| Liquor/wood ratio (ml/g) | 10 | 10 | 10 | 10 |
| Max. cooking temp., °C. | 230 | 230 | 230 | 230 |
| Residence time, Min. | 15 | 15 | 15 | 15 |
| Initial pH | 6.0 | 6.1 | 8.5 | 9.5 |
| Final pH | 3.3 | 4.1 | 5.6 | 7.3 |
| Pulp Yield (wt % wood) | 45.5 | 48.6 | 54.8 | 57.1 |
| Residual Lignin (wt % pulp) | 21.8 | 7.0 | 17.1 | 6.5 |

In the above Table 1, the starting wood material was Tulip Poplar (lirodendron tulipfera) chips comminuted to a nominal 1 mm particle size and which were degassed, immersed and soaked in the relevant liquor to impregnate the material prior to the cooking. In Example 1, the liquor consisted of water only. In Examples 2 and 4, 55 vol % ethanol was also present in the liquor plus, in example 4, acid neutralizing agent in amount of 27 wt % of dry wood. In Example 3, the liquor consisted of water and acid neutralizing agent in amount of 20 wt. % of dry wood. The reactants were charged into the reactor and heated at a rate of about 6° C./minute to the maximum temperature, held at that temperature for 15 minutes and rapidly cooled at a rate of about 10° C./minute to a temperature of less than 150° C. The products were filtered, washed and dried to obtain pulp yield. The lignin content of the pulps was either determined directly using the Klason method (TAPPI Standard T222) or indirectly by determining the Kappa number of the pulp using TAPPI Standard T235 OS-76.

Table 1 illustrates that digestion in water only, Example 1, provides an acid final pH of 3.3 which is responsible for the low yield of pulp (45.5% based on dry wood) and the high residual lignin content (21.8 wt % of pulp). The results of Example 2 illustrate that the addition of alcohol reduces the residual lignin content significantly (to 7.0 wt % of pulp) but increases the pulp yield only slightly (to 48.6 wt % of wood) due primarily to the acid final pH of 4.1. The results of Example 3 illustrate that the addition of acid neutralizing agent to the water, although increasing the pulp yield significantly (to 54.8 wt % of wood) has only a slight effect on the residual lignin content (17.1 wt % of pulp). However, Example 4 demonstrates that the addition of both the alcohol and the acid neutralizing agent provides the best pulp yield (57.1 wt % of wood) and the lowest residual lignin content (6.5 wt % of pulp), the final pH being 7.3

TABLE 2

| Example | 5 | 6 | 7 |
|---|---|---|---|
| Neutralizing Agent, Sodium bicarbonate (wt % wood) | 13.3 | 33.3 | 7.9* |
| Alcohol (ethanol) (vol % liquor) | 70 | 30 | 50 |
| Liquor/wood ratio (ml/g) | 10 | 10 | 10 |
| Max. cooking temp., °C. | 230 | 230 | 230 |
| Residence time, Min. | 15 | 15 | 15 |
| Final pH | 6.6 | 7.3 | 6.8 |
| Pulp Yield (wt % wood) | 59.2 | 52.5 | 60.2 |
| Residual Lignin (wt % pulp) | 9.3 | 6.0 | 9.8 |

*Acid neutralizing agent is sodium carbonate.

The conditions for Example 5–7 were the same as those for Examples 1–4, except that, as noted in Table 2, the amounts of alcohol (ethanol) were different from those of Examples 2 and 4 of Table 1. Examples 5 and 6 illustrate that varying the amounts of a different acid neutralizing agent alters the final pH and in combination with the varying amounts of alcohol and the higher maximum cooking temperature provides different pulp yields and residual lignin contents. Example 7, using about the same amount of alcohol as in Example 4 but considerably lesser amount of acid neutralizing agent (7.9 wt. % of wood as opposed to 27 wt % of wood again alters the final pH and in combination with the higher maximum cooking temperature provides both a slightly higher pulp yield and a substantially greater residual lignin content as compared with Example 4. Examples 5–7 also show that varying the amount of alcohol from 30–70 vol. % of liquor had little effect on the process.

TABLE 3

| Example | 8 | 9 | 10 | 11 |
|---|---|---|---|---|
| Neutralizing Agent, Sodium bicarbonate (wt % wood) | 17.5 | 23.0 | 23.0 | 23 |
| Alcohol (ethanol) | 60 | 60 | 60* | 60 |

TABLE 3-continued

| Example | 8 | 9 | 10 | 11 |
|---|---|---|---|---|
| (vol % liquor) | | | | |
| Liquor/wood ratio (ml/g) | 20 | 5 | 10 | 30 |
| Max. cooking temp., °C. | 215 | 230 | 230 | 230 |
| Residence time, Min. | 15 | 15 | 15 | 15 |
| Final pH | 7.6 | 7.8 | 7.1 | 7.2 |
| Pulp Yield (wt % wood) | 64.5 | 63.3 | 61.5 | 57.0 |
| Residual Lignin (wt % pulp) | 9.9 | 7.9 | 5.9 | 5.8 |

*n-propanol

Examples 9, 10 and 11 show the effect of changes in the liquor to wood ratio, all other conditions remaining the same with the lone exception of using n-proponal as the alcohol in Example 10 in place of ethanol. A two-fold increase in the liquor/wood ratio, Examples 9 and 10, resulted in a slight decrease in pulp yield while lowering the residual lignin content. Example 11 shows that there is little to be gained from increasing the liquor/wood ratio above 10 ml/g. Example 8 shows that a lower maximum cooking temperature of 215° C. slightly increased the pulp yield but resulted in a greatly higher residual lignin content over what would be expected for a maximum cooking temperature of 230° C. based on Examples 9–11.

TABLE 4

| Example | 12 | 13 | 14 | 15* |
|---|---|---|---|---|
| Neutralizing Agent, Sodium bicarbonate (wt % wood) | 26.7 | 23.0 | 23.0 | 23.0 |
| Alcohol (ethanol) (vol % liquor) | 55 | 60 | 60 | 60 |
| Liquor/wood ratio (ml/g) | 10 | 10 | 10 | 10 |
| Max. cooking temp., °C. | 240 | 255 | 270 | 270 |
| Residence time, Min. | 0 | 0 | 0 | 0 |
| Final pH | 7.3 | 7.6 | 7.0 | 7.1 |
| Pulp Yield (wt % wood) | 60.2 | 59.3 | 53.4 | 53.2 |
| Residual Lignin (wt % pulp) | 8.3 | 5.6 | 2.5 | 1.3 |

*This Example also contains MAQ in amount of 4 wt % of wood.

Table 4 illustrates various Examples in which the third cooking stage is omitted (no residence time) at various high temperature. This Table clearly shows that yields of greater than 50% with very low residual lignin content are possible for the higher temperatures in the maximum cooking temperature range. Some sacrifice in % yield by going to the higher temperature will allow greater reduction in the residual lignin content.

TABLE 5

| Example | 4 | 16 | 17 | 18 |
|---|---|---|---|---|
| Type of Additive* | none | 2-Nap | AQ | MAQ |
| (wt % wood) | 0 | 4 | 4 | 4 |
| Neutralizing Agent, Sodium bicarbonate (wt. % liquor) | 27 | 21 | 20 | 23.3 |
| Alcohol (ethanol) (vol % liquor) | 55 | 60 | 60 | 60 |
| Liquor/wood ratio (ml/g) | 10 | 10 | 10 | 10 |
| Max. cooking temp., °C. | 230 | 230 | 230 | 230 |
| Residence time, Min. | 15 | 15 | 15 | 15 |
| Final pH | 7.3 | 6.8 | 7.3 | 7.3 |
| Pulp Yield (wt % wood) | 57.1 | 58.9 | 60.6 | 61.0 |
| Lignin-free pulp (wt % wood) | 53.4 | 55.8 | 57.8 | 59.4 |
| Residual Lignin (wt % pulp) | 6.5 | 5.3 | 4.7 | 2.7 |

*2-Nap = 2-Napthol
AQ = Anthraquinone
MAQ = Methylanthraquinone

Investigation of the process was performed to determine the effects of various additives to the solvent system. A summary of these results is included in Table 5. The additives tested, methylanthraquinone, anthraquinone, and 2-naphthol, increased the yield primarily by increasing the quantity of the lignin-free pulp, reflecting improved carbohydrate stabilization. Quinonoid type compounds, in particular, are known to block carbohydrate peeling reactions by oxidizing the reducing end of carbohydrate polymers which would otherwise degrade. As a result, significant increases in the pulp yield were observed. Also noteworthy is the reduction of the residual lignin content despite the higher retention of carbohydrate. Methylanthraquinone (MAQ), Example 18, is the most beneficial additive of the three, providing the highest pulp and the lowest lignin content. All three of these additives increase the extent of delignification by blocking lignin condensation reactions.

Table 5 compares the results of Example 4 (no additive) with several Examples which do employ additives and the comparison clearly illustrates the superior results in both % yield and residual lignin content which is possible with the use of an additive. Thus, the use of an additive contributes both to preservation of carbohydrates and delignification of the material.

TABLE 6

| Example | Tulip poplar | 4 | 18 |
|---|---|---|---|
| CARBOHYDRATES:* | | | |
| Glucan | 49.5 | 39.4 | 44.4 |
| Xylan | 17.2 | 9.5 | 12.4 |
| Mannan | 3.7 | 1.3 | 1.2 |
| Galactan | 0.98 | 0.26 | 0.64 |
| Arabinan | 0.69 | 0.30 | 0.64 |
| Total Carbohydrates | 72.1 | 50.8 | 58.9 |

*Carbohydrate analysis done by alditol acetate method.

Table 6 compares the original wood carbohydrate content with the carbohydrate content of Examples 4 and 18, the former employing no additive and the latter employing the additive MAQ. As is the case with Table 5, Table 6 demonstrates the superiority of additive usage.

The stablization of carbohydrates through acid neutralization and the addition of MAQ is illustrated in Table 6. Comparing Example 18 with the original wood, 90% of the original glucan and over 70% of the original xylan has been preserved after pulping with MAQ. Even without MAQ, Example 4 retains over 50% of the original xylan. The losses of glucan an xylan incurred may be due to the initial pH greater than 9 (see Example 4 Table 1) and dissolution of hemicellulose bonded to soluble lignin. Improved control of the pH beyond the use of acid neutralizing agent is limited by the reactor used in these studies which does not permit controlled additions of acid neutralizing agent to the reacting mixture once the heating cycle has started.

TABLE 7

| Example | 19 | 20 | 21 |
|---|---|---|---|
| Type of Additive (wt % wood) | MAQ 1 | MAQ/ 2-naphthol 4/4 | MAQ 15 |
| Neutralizing Agent, Sodium bicarbonate (wt % wood) | 26.7 | 23 | 23 |
| Alcohol (ethanol) (vol % liquor) | 50 | 60 | 60 |
| Liquor/wood ratio (ml/g) | 10 | 10 | 10 |
| Max. cooking temp., °C. | 200 | 230 | 230 |
| Residence time, Min. | 25 | 10 | 10 |
| Final pH | 7.2 | 7.6 | 7.5 |
| Pulp Yield (wt % wood) | 61.3 | 59.7 | 60.2 |
| Residual Lignin (wt % pulp) | 9.8 | 2.8 | 3.3 |

Table 7 shows that the addition of MAQ of up to 15 weight % based upon dry wood serves the dual function of increasing pulp yield while decreasing residual lignin content. As illustrated by Example 20 it is also possible to mix additives. However, in view of Example 18, it does not appear advantageous to use more than 4 wt % MAQ.

Having now fully described our invention, it is to be understood that the following claims are to be construed not by the specific Examples noted above, but within the wider latitude afforded by the description as a whole.

What is claimed is:

1. A process for extracting lignin from lignocellulosic material to recover reactive lignin and to yield high quality cellulosic pulp, which comprises the steps of:

(a) impregnating lignocellulosic material with a liquor which comprises an aqueous organic solvent, capable of solvating lignin, and an acid neutralizing agent;

(b) cooking the lignocellulosic material in its liquor by heating the liquor with the impregnated lignocellulosic material submerged therein from a temperature of about 150° C. through a temperature range of 150°–175° C. to a selected maximum temperature in the maximum temperature range of 200° C. to 280° C. and then cooling the liquor with material submerged therein to a temperature of less than about 150° C.;

(c) maximizing reactive lignin solvation while suppressing cellulose degradation during step (b) by:

i. controlling the amount of neutralizing agent in step (a) and controlling the time at which the liquor with the impregnated resin is within the temperature range of 150°–175° C. to a range of 4–10 minutes to achieve a pH for step (b) of from 6.0 to 8.0 in the liquor before heating above 175° C. in step (b), and ii. controlling the time at which the liquor is at the selected maximum temperature during step (b) in inverse relation to the selected maximum temperature so that the time at which the liquor is held at the selected maximum temperature of 200° C. is at least about 25–30 minutes and for correspondingly lesser times at selected maximum temperatures greater than 200° C. by rapidly cooling the liquor from the selected maximum temperature to said temperature of less than about 150° C. to terminate step (b); and (d) recovering reactive lignin and high quality cellulose pulp from the cooled liquor.

2. The process of claim 1 wherein, in step (b), the liquor is heated to temperatures above about 175° C. at a rate which is higher than the rate at which the liquor is heated to temperatures from about 150° C. to about 175° C.

3. The process of claim 2 wherein the liquor is cooled during step (b) at a rate at least as great as the rate at which the liquor is heated to temperatures above about 175° C.

4. The process of claim 2 wherein the rate at which the liquor is heated from about 150° C. to about 175° C. is in the range of about 3° C./minute to about 6° C./minute.

5. The process of claim 3 wherein the rate at which the liquor is heated from about 175° C. to the maximum temperature is at least about 10° C./minute.

6. The process of claim 4 wherein the rate at which the liquor is heated from about 175° C. to the maximum temperature is at least about 10° C./minute.

7. The process of claim 3 wherein the rate at which the liquor is heated from about 150° C. to about 175° C. is in the range of about 3° C./minute to about 6° C./minute.

8. The process of claim 7 wherein the rate at which the liquor is heated from about 175° C. to the maximum temperature is at least about 10° C./minute.

9. The process of claim 1 wherein the pH of the liquor attained in step (b) is in the range of 6.8–7.5.

10. The process of claim 1 which includes the step of comminuting the lignocellulosic material to a particle size of not more than about 1 mm prior to step (a).

11. A process as defined in claim 1 wherein the ratio of liquor to liqnocellulosic material of step (a) is from about 4 to about 30 ml/g.

12. A process as defined in claim 1 wherein the ratio of liquor to lignocellulosic material of step (a) is from about 4 to about 10 ml/g.

13. A process as defined in claim 1 wherein the aqueous organic solvent comprises water and an organic solvent selected from the group consisting of straight-chain or branched-chain alcohols having up to about 8 carbons, lower aliphatic ketones, ethylene glycol and dioxane.

14. A process as defined in claim 13 wherein the volume percent of alcohol in the aqueous organic solvent is from about 30 to about 70.

15. A process as defined in claim 1 wherein said liquor further comprises an aromatic additive selected from the group consisting of quinones containing electron donating groups and fused aromatic ring compounds capable of undergoing a single electrophilic substitution.

16. A process as defined in claim 15 wherein said aromatic additive is present in said liquor in an amount of up to 15 weight % based upon dry weight of lignocellulosic material.

17. A process as defined in claim 15 wherein said aromatic additive is present in said liquor in an amount of up to 4 weight % based upon dry weight of lignocellulosic material.

18. A process as defined in claim 1 wherein the total cooking time of step (b) is in the range of about 32–47 minutes.

* * * * *